US010784599B2

(12) United States Patent
Schrader et al.

(10) Patent No.: US 10,784,599 B2
(45) Date of Patent: Sep. 22, 2020

(54) CONNECTION CLIP

(71) Applicant: Phoenix Contact GmbH & Co. KG, Blomberg (DE)

(72) Inventors: Andreas Schrader, Delbrueck (DE); Markus Kettern, Lemgo (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/310,474

(22) PCT Filed: Jun. 6, 2017

(86) PCT No.: PCT/EP2017/063682

§ 371 (c)(1),
(2) Date: Dec. 17, 2018

(87) PCT Pub. No.: WO2018/010893

PCT Pub. Date: Jan. 18, 2018

(65) Prior Publication Data

US 2019/0341708 A1 Nov. 7, 2019

(30) Foreign Application Priority Data

Jul. 13, 2016 (LU) ..... 93148

(51) Int. Cl.
*H01R 9/24* (2006.01)
*H01R 4/48* (2006.01)

(52) U.S. Cl.
CPC ..... *H01R 9/24* (2013.01); *H01R 4/4836* (2013.01); *H01R 4/4845* (2013.01)

(58) Field of Classification Search
CPC .. H01R 4/4827; H01R 4/4818; H01R 4/4836; H01R 4/4845; H01R 9/24
(Continued)

(56) References Cited

U.S. PATENT DOCUMENTS 4,759,726 A * 7/1988 Naylor ..... H01R 4/5008 439/441
5,915,991 A * 6/1999 Roman ..... H01R 4/4827 439/441

(Continued)

FOREIGN PATENT DOCUMENTS

DE 4408985 A1 9/1994
DE 69703829 T2 7/2001

(Continued)

*Primary Examiner* — Gary F Paumen
(74) *Attorney, Agent, or Firm* — Leydig, Voit & Mayer, Ltd.

(57) ABSTRACT

A connection terminal for connecting an electrical conductor includes: a housing; a current bar arranged in the housing; a clamping spring arranged in the housing; and a pivotally mounted actuation lever. The clamping spring is transferrable to an open position and to a closed position vis-à-vis a pivoting movement of the actuation lever. The clamping spring includes a clamping limb for clamping a conductor that is inserted into the housing against the current bar in the closed position. An actuation tab is arranged on the clamping limb such that when the clamping spring is transferred from the closed position to the open position, a compressive force is applied to the actuation tab by the actuation lever.

6 Claims, 2 Drawing Sheets

(58) Field of Classification Search
USPC ..... 439/441
See application file for complete search history.

(56) References Cited

U.S. PATENT DOCUMENTS

| | | | | |
|---|---|---|---|---|
| 6,666,707 | B2 * | 12/2003 | Moret Codina ..... | H01R 4/4836 200/51.09 |
| 7,785,134 | B2 * | 8/2010 | Dhandapani ..... | H01R 4/4818 439/441 |
| 8,129,641 | B2 * | 3/2012 | Majewski ..... | H01R 4/4845 200/335 |
| 8,794,994 | B2 * | 8/2014 | Kollmann ..... | H01R 4/4836 439/441 |
| 9,680,237 | B2 * | 6/2017 | Aporius ..... | H01R 4/4836 |
| 2011/0318972 | A1 | 12/2011 | Koellmann | |
| 2015/0372401 | A1 | 12/2015 | Stolze | |
| 2016/0049737 | A1 * | 2/2016 | Aporius ..... | H01R 4/4836 439/733.1 |
| 2018/0205159 | A1 | 7/2018 | Glammerer et al. | |
| 2018/0248276 | A1 | 8/2018 | Kettern | |

FOREIGN PATENT DOCUMENTS

| | | | |
|---|---|---|---|
| DE | 102010024809 | A1 | 12/2011 |
| DE | 102011110640 | A1 | 2/2013 |
| DE | 102012110895 | A1 | 5/2014 |
| DE | 202013101582 | U1 | 7/2014 |
| DE | 102014114026 | A1 | 3/2016 |
| DE | 102015115612 | A1 | 3/2017 |
| JP | 2003077558 | A | 3/2003 |
| JP | 2003249283 | A | 9/2003 |
| JP | 2016507148 | A | 3/2016 |

* cited by examiner

CONNECTION CLIP

CROSS-REFERENCE TO PRIOR APPLICATIONS

This application is a U.S. National Phase application under 35 U.S.C. § 371 of International Application No. PCT/EP2017/063682, filed on Jun. 6, 2017, and claims benefit to Luxembourg Patent Application No. LU93148, filed on Jul. 13, 2016. The International Application was published in German on Jan. 18, 2018 as WO 2018/010893 under PCT Article 21(2).

FIELD

The invention relates to a connection terminal for connecting an electrical conductor, comprising a housing, a current bar arranged in the housing, a clamping spring arranged in the housing and a pivotally mounted actuation lever, it being possible for the clamping spring to be transferred to an open position and to a closed position by means of a pivoting movement of the actuation lever, and the clamping spring comprising a clamping limb for clamping a conductor inserted into the housing against the current bar in the closed position.

BACKGROUND

A corresponding connection terminal in which a clamping spring can be transferred to an open position and a closed position by means of an actuation lever is known from DE 697 03 829 T2. The actuation lever is pivotally mounted in the housing. The actuation lever comprises a rounded arm by means of which the actuation lever grips the clamping spring on a tension element formed on the clamping spring in order to transfer the clamping spring from the closed position to the open position by applying a tensile force. The structure of the clamping spring, and of the connection terminal as a whole, is very elaborate and complex. Connecting a conductor using a connection terminal of this type is also less convenient for a user.

SUMMARY

In an embodiment, the present invention provides a connection terminal for connecting an electrical conductor, comprising: a housing; a current bar arranged in the housing; a clamping spring arranged in the housing; and a pivotally mounted actuation lever, wherein the clamping spring is transferrable to an open position and to a closed position by a pivoting movement of the actuation lever, wherein the clamping spring comprises a clamping limb configured to clamp a conductor that is inserted into the housing against the current bar in the closed position, and wherein an actuation tab is arranged on the clamping limb such that when the clamping spring is transferred from the closed position to the open position, a compressive force is applied to the actuation tab by the actuation lever.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
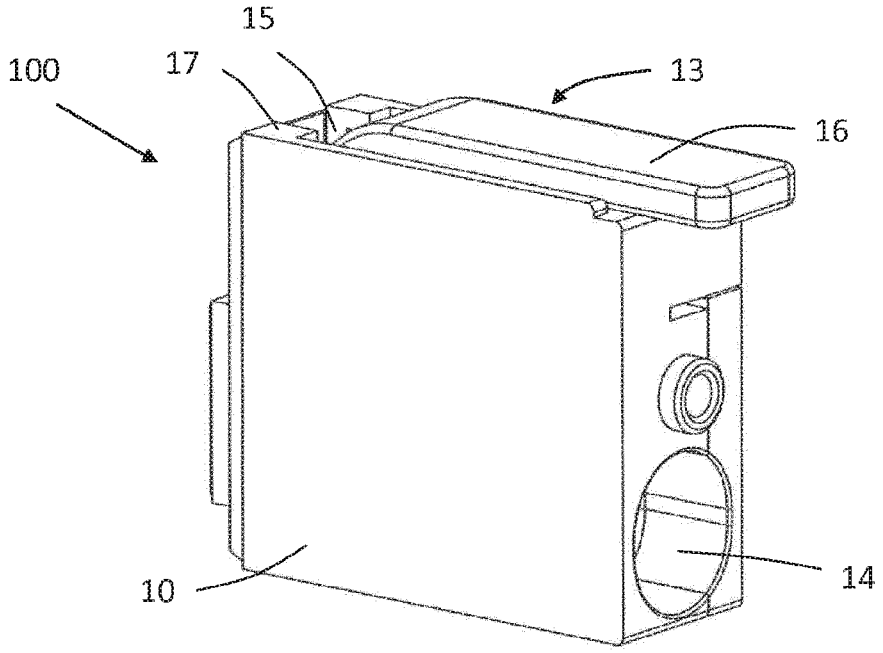
FIG. 1 is a schematic view of a connection terminal according to the invention.

An aspect of the present invention provides a connection terminal which allows a conductor to be securely connected and the structure of the connection terminal to be less complex.

The connection terminal according to the invention is characterized in that an actuation tab is arranged on the clamping limb such that when the clamping spring is transferred from the closed position to the open position, a compressive force is applied to the actuation tab by the actuation lever. According to the invention, a compressive force, rather than a tensile force, is applied to the actuation tab and thus to the clamping spring by means of an actuation lever in order to open said spring. The actuation tab is arranged directly on the clamping limb of the clamping spring, such that the force that acts on the actuation tab can directly cause the clamping limb to move without the need to use additional elements that are independent of the clamping spring or elements that are additionally provided on the clamping spring. Loss of energy from the acting compressive force for actuating the clamping limb of the clamping spring can thus be prevented. The connection terminal is thus highly efficient, and therefore a conductor can be connected and released very securely. Ease of operation for a user of the connection terminal can therefore also be significantly improved. The direct action on the clamping limb via the actuation tab linked thereto also allows the structural design of the connection terminal to be less complex. The compressive force applied to the actuation tab preferably acts counter to the direction in which the conductor is inserted into the connection terminal, and also counter to the movement direction of the clamping limb during the movement from the closed position to the open position. When the actuation lever pivots, the actuation lever presses against the actuation tab and the actuation tab is consequently also moved, in particular pivoted, together with the clamping limb of the clamping spring arranged thereon. In contrast, the contact limb of the clamping spring, which contact limb is linked to the clamping limb by means of a curved connection portion, preferably remains in position and is not moved or pivoted when the compressive force is applied to the actuation tab.

The actuation tab is preferably arranged on the clamping limb only on one side. The actuation tab is preferably arranged on a transverse lateral face of the clamping limb that extends along the length of the clamping limb. The fact that the actuation tab is linked to the clamping limb on one side allows the width of the connection terminal to be reduced.

The actuation tab is preferably divided into two regions. The actuation tab preferably comprises a linking region that is arranged directly on the clamping limb and a pressure region that is arranged on the linking region, the pressure region preferably being spaced apart from the clamping limb. The pressure region is the region of the actuation tab at which the compressive force is applied to the actuation tab by the actuation lever. The pressure region preferably does not come into direct contact with the clamping limb, and instead only comes into direct contact with the linking region which is connected to the clamping limb.

The pressure region is preferably formed in a different plane from the linking region. The plane spanned by the pressure region is preferably formed at an angle of >0, preferably at an angle of >45°, with respect to the plane spanned by the linking region. The pressure region is preferably formed at an angle of 90° with respect to the linking region. The pressure region preferably extends along the width of the clamping spring, and thus transversely to the longitudinal extension of the clamping spring or of the clamping limb of the clamping spring, such that the compressive force that acts on the pressure region at an angle of 90° acts along the longitudinal extension of the clamping spring or of the clamping limb of the clamping spring. The clamping spring can thus be prevented from tilting laterally when the compressive force is applied to the actuation tab.

In order to achieve a secure link between the actuation tab and the clamping spring and thus to be able to securely transfer the compressive force that acts on the actuation tab to the clamping spring, the actuation tab and the clamping spring are preferably formed integrally with one another. In this case, the clamping spring and the actuation tab are preferably formed by a metal strip so as to be curved.

A peg-shaped actuation region is preferably formed on the actuation lever for applying the compressive force. A defined compressive force having a defined pressure point can be applied to the actuation tab by means of the peg-shaped actuation region.

In order to increase ease of operation for the user of the connection terminal, the actuation lever can be positioned with respect to the actuation tab such that the actuation lever is held in the open position in a self-locking manner. The self-locking effect allows the actuation lever to remain in the open position independently, and said lever therefore does not need to be held in position by the user. The self-locking effect is preferably designed such that, in the open position, a pressure point that acts when the compressive force is applied to the actuation tab by means of the actuation lever is arranged above a swivel pin of the actuation lever. A self-locking effect of the actuation lever can therefore be achieved without significant design complexity.

FIG. 1 shows a connection terminal 100 for connecting an electrical conductor.

Figure 2:
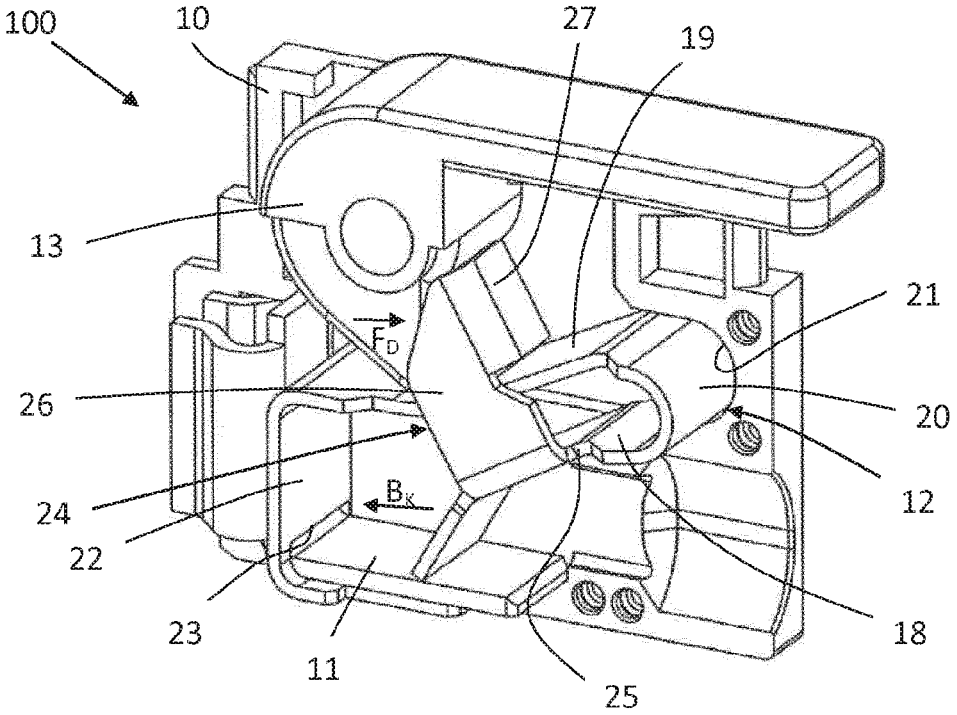
FIG. 2 is a schematic partial sectional view of the connection terminal shown in FIG. 1 with the clamping spring in the closed position.

The connection terminal 100 comprises a housing 10 in which a current bar 11, a clamping spring 12 and an actuation lever 13 are received, as can be seen in particular in FIG. 2. The housing 10 is formed in two parts, the two housing parts being detachably connected to one another via a plug connection or a screw connection. A conductor insertion opening 14 via which a conductor to be connected can be inserted into the connection terminal 100 is arranged in the housing 10. The housing 10 also comprises an opening 15 via which a part of the actuation lever 13, in particular a handle 16 for actuating the actuation lever 13, protrudes from the housing 10. The opening 15 is formed in an upper face 17 of the housing 10.

As can be seen in FIG. 2, the clamping spring 12 comprises a clamping limb 18 and a contact limb 19 which are interconnected by means of a curved connection portion 20. The clamping spring 12 is mounted in the housing 10 such that the clamping limb 18 is movable, so that the clamping spring 12 can be transferred into an open position in which a conductor to be connected can be inserted into and released from the clamping space that is formed by the clamping spring 12 and the current bar 11, and into a closed position in which a conductor to be connected is clamped against the current bar 11 by the clamping limb 18.

The housing 10 has a curved inner contour 21 that is adapted to the shape of the curved connection portion 20 such that the curved connection portion 20 can rest against the inner contour 21 in a precise fit and the clamping spring 12 can thus be secured in the housing 10. Unlike the clamping limb 18, the contact limb 19 is arranged in the housing 10 rigidly such that when the clamping spring 12 is transferred to the open position and the closed position, the contact limb 19 does not move, but instead remains in position.

A U-shaped projection 22 which is used as a stop or penetration guard for a conductor that is inserted into the housing 10 is arranged on the clamping spring 12. The projection 22 also receives the current bar 11, by virtue of the fact that the projection 22 comprises an opening 23 through which the current bar 11 is fed such that the current bar 11 rests flat against an inner face of the projection 22. The projection 22 is formed integrally with the clamping spring 12, the projection 22 being connected to the contact limb 19. The clamping spring 12, together with the projection 22, is formed by a curved metal strip.

Figure 3:
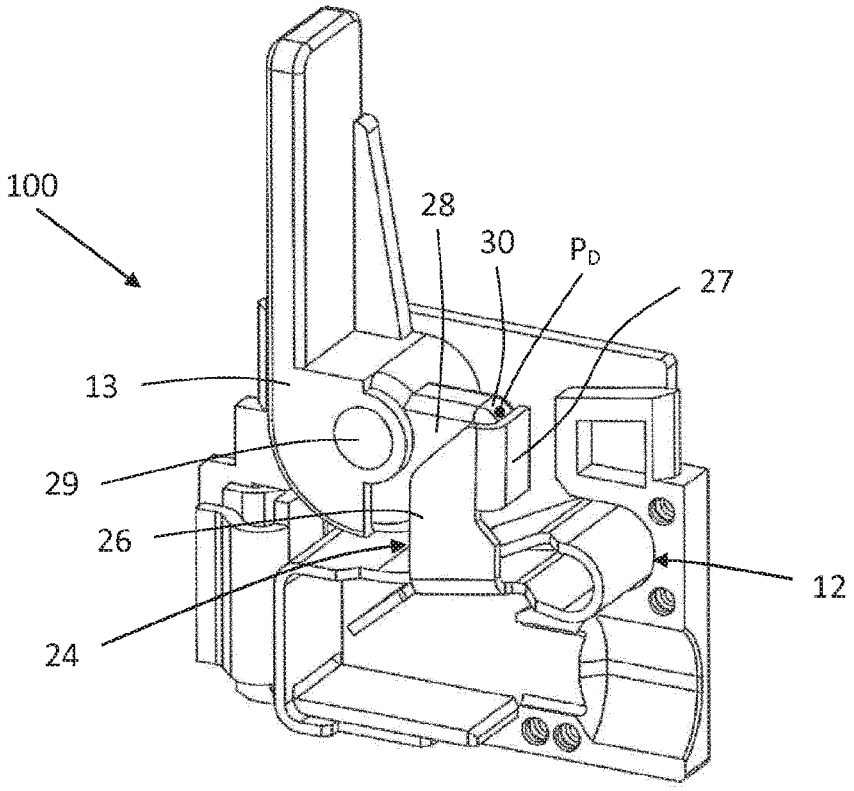
FIG. 3 is a schematic partial sectional view of the connection terminal shown in FIG. 1 with the clamping spring in the open position.
Figure 4:
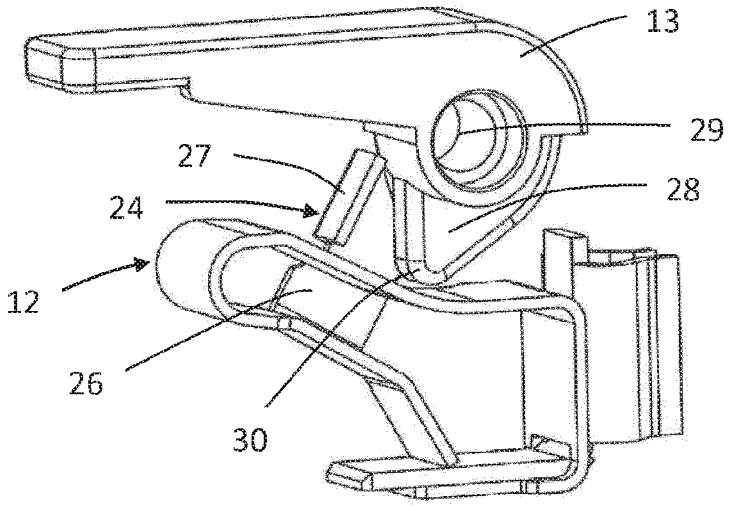
FIG. 4 is another view of part of the connection terminal shown in FIG. 1 with the clamping spring in the closed position.

Furthermore, an actuation tab 24 is arranged on the clamping spring 12, which tab is arranged on the clamping limb 18 of the clamping spring 12 such that when the clamping spring 12 is transferred from the closed position to the open position, the actuation lever 13 applies a compressive force $F_D$ to the actuation tab 24. In order to transfer the clamping spring 12 from the closed position to the open position, force is not applied directly to the clamping spring 12, in particular to the clamping limb 18 of the clamping spring 12, but is instead applied indirectly via the actuation tab 24. The compressive force $F_D$ acts counter to the movement direction $B_K$ or the deflection of the clamping limb 18 during the movement from the closed position to the open position. FIGS. 2 and 4 show the clamping spring 12 in the closed position and FIG. 3 shows the clamping spring 12 in the open position.

The actuation tab 24 is linked to the clamping limb 18 of the clamping spring 12 on one side, the actuation tab 24 being linked to a transverse lateral face 25 of the clamping limb 18 that extends along the length of the clamping limb 18. In the embodiment shown here, the actuation tab 24 is formed integrally with the clamping limb 18 and thus with the clamping spring 12.

The actuation tab 24 is divided into two regions, namely a linking region 26 and a pressure region 27.

The linking region 26 is the region by means of which the actuation tab 24 is linked to the clamping limb 18 of the clamping spring 12. The linking region 26 extends laterally with respect to the clamping spring 12 and extends, beginning at the clamping limb 18, beyond the contact limb 19 such that the linking region 26 overlaps the contact limb 19.

Unlike the linking region 26, the pressure region 27 is spaced apart from the clamping limb 18, such that there is no direct connection between the pressure region 27 and the clamping limb 18. The pressure region 27 is the region at which the compressive force $F_D$ is applied to the actuation tab 24 by means of the actuation lever 13. The pressure region 27 is arranged above the contact limb 19. The pressure region 27 is preferably formed at an angle of 90° with respect to the linking region 26. The pressure region 27 extends along the width of the clamping spring 12 and thus transversely to the longitudinal extension of the clamping spring 12 or of the clamping limb 18 and the contact limb 19 of the clamping spring 12, such that the compressive force $F_D$ that acts on the pressure region 27 at an angle of 90° acts along the longitudinal extension of the clamping spring 12 or of the clamping limb 18 of the clamping spring 12. The pressure region 27 extends over the entire width of the clamping spring 12.

A peg-shaped actuation region 28 that presses directly against the pressure region 27 of the actuation tab 24 (which can be seen in particular in FIG. 3) is formed on the actuation lever 13 for applying the compressive force $F_D$. While moving from the closed position to the open position, the actuation lever 13, together with the peg-shaped actuation region 28, rolls on the surface of the pressure region 27 in order to apply the compressive force $F_D$. For this reason, the actuation lever 13 is pivotally mounted about a swivel pin 29.

The actuation lever 13 is positioned with respect to the actuation tab 24 such that the actuation lever 13 is held in the open position in a self-locking manner, and thus remains in the open position independently, as shown in FIG. 3, without the need for a user to hold the actuation lever 13 in said position. In order to achieve the self-locking effect, a pressure point $P_D$ that acts when the compressive force $F_D$ is applied to the actuation tab 24 by means of the actuation lever 13 is arranged above the swivel pin 29 in the open position. The pressure point $P_D$ is the point by means of which the tip 30 of the peg-shaped actuation region 28 of the actuation lever 13 presses against the pressure region 27 of the actuation tab 24 in the open position. In order to transfer the clamping spring 12 from the open position to the closed position so as to close the clamping space, the actuation lever 13 is rotated back over said pressure point $P_D$ by a user.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

Connection terminal 100
Housing 10
Current bar 11
Clamping spring 12
Actuation lever 13
Conductor insertion opening 14
Opening 15
Handle 16
Upper face 17
Clamping limb 18
Contact limb 19
Curved connection portion 20
Inner contour 21
Projection 22
Opening 23
Actuation tab 24
Transverse lateral face 25
Linking region 26
Pressure region 27
Actuation region 28
Swivel pin 29
Tip 30
Compressive force $F_D$
Movement direction of the clamping limb of the $B_K$ clamping spring
Pressure point $P_D$

The invention claimed is:

1. A connection terminal for connecting an electrical conductor, comprising:
- a housing;
- a current bar arranged in the housing;
- a clamping spring arranged in the housing; and
- a pivotally mounted actuation lever,
- wherein the clamping spring is transferrable to an open position and to a closed position by a pivoting movement of the actuation lever,
- wherein the clamping spring comprises a clamping limb configured to clamp a conductor that is inserted into the housing against the current bar in the closed position,
- wherein an actuation tab is arranged on the clamping limb such that when the clamping spring is transferred from the closed position to the open position, a compressive force is applied to the actuation tab by the actuation lever,
- wherein the actuation lever is positioned with respect to the actuation tab such that the actuation lever is held in the open position in a self-locking manner, and
- wherein the self-locking is achieved by a pressure point that acts when the compressive force is applied to the actuation tab by the actuation lever being arranged above a swivel pin of the actuation lever in the open position.

2. The connection terminal according to claim 1, wherein the actuation tab is arranged on the clamping limb on one side.

3. The connection terminal according to claim 1, wherein the actuation tab comprises a linking region that is arranged directly on the clamping limb and a pressure region that is arranged on the linking region, the pressure region being spaced apart from the clamping limb.

4. The connection terminal according to claim 3, wherein the pressure region is formed at an angle of 90° with respect to the linking region.

5. The connection terminal according to claim 1, wherein the actuation tab and the clamping spring are formed integrally with one another.

6. The connection terminal according to claim 1, further comprising a peg-shaped actuation region formed on the actuation lever for applying the compressive force.

* * * * *